US007051891B2

(12) United States Patent
Darr et al.

(10) Patent No.: US 7,051,891 B2
(45) Date of Patent: May 30, 2006

(54) PLASTIC CONTAINER HAVING LABEL PANELS

(75) Inventors: Richard C. Darr, Medina, OH (US); James C. Dorn, Norton, OH (US); Richard A. Lovelace, Jr., Akron, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 10/769,829

(22) Filed: Feb. 2, 2004

(65) Prior Publication Data

US 2005/0077265 A1 Apr. 14, 2005

Related U.S. Application Data

(63) Continuation-in-part of application No. 29/191,818, filed on Oct. 14, 2003, now Pat. No. Des. 498,677.

(51) Int. Cl.
*B65D 1/18* (2006.01)
*B65D 1/42* (2006.01)

(52) U.S. Cl. ..... 215/383; 215/384; 215/398; 40/310

(58) Field of Classification Search ..... 215/382, 215/383, 396, 398, 378; 220/669, 771, 601; 40/306, 307, 310
See application file for complete search history.

(56) References Cited

U.S. PATENT DOCUMENTS

| | | | | | |
|---|---|---|---|---|---|
| 2,920,777 | A | * | 1/1960 | Cole | 215/380 |
| 3,176,879 | A | * | 4/1965 | Mojonnier | 222/143 |
| 4,579,260 | A | * | 4/1986 | Young et al. | 222/465.1 |
| 4,609,106 | A | * | 9/1986 | Gentili | 206/509 |
| 4,923,098 | A | * | 5/1990 | Schoonover et al. | 222/465.1 |
| 4,969,922 | A | * | 11/1990 | Platte, Sr. | 215/383 |
| D339,022 | S | * | 9/1993 | McGinnis et al. | D7/306 |
| D358,548 | S | * | 5/1995 | Platte | D9/527 |
| D385,795 | S | * | 11/1997 | Wysocki et al. | D9/531 |
| D395,821 | S | * | 7/1998 | Tabaroni et al. | D9/416 |
| 5,884,802 | A | * | 3/1999 | Leibowitz | 220/771 |
| 6,068,161 | A | * | 5/2000 | Soehnlen et al. | 222/143 |
| D431,472 | S | * | 10/2000 | Cain et al. | D9/524 |
| D452,956 | S | * | 1/2002 | Hari et al. | D9/527 |
| D470,056 | S | * | 2/2003 | Schlueter | D9/531 |
| 6,779,673 | B1 | * | 8/2004 | Melrose et al. | 215/381 |
| 2003/0010743 | A1 | * | 1/2003 | Buokobza | |

FOREIGN PATENT DOCUMENTS

WO WO 96/01212 * 1/1996

* cited by examiner

*Primary Examiner*—Sue A. Weaver
(74) *Attorney, Agent, or Firm*—Robert H. Bachman

(57) ABSTRACT

The container includes a hollow body of plastic material having a lower supporting base, a sidewall extending upwardly from the lower base, and an upper portion extending upwardly from the sidewall. The upper portion includes at least one opening therein. Two label panels are provided on the container spaced from each other, one on the upper portion and one on the sidewall. An integral handle is also provided positioned at least in part on the sidewall.

14 Claims, 7 Drawing Sheets

PLASTIC CONTAINER HAVING LABEL PANELS

CROSS-REFERENCE TO RELATED APPLICATIONS

This application is a continuation-in-part of U.S. patent application Ser. No. 29/191,818 for CONTAINER, filed Oct. 14, 2003, U.S. Pat. No. D 498,677.

BACKGROUND OF THE INVENTION

Plastic containers, especially blow molded plastic containers in larger sizes, are frequently desired to be placed in coolers or refrigerators in different orientations. For example, it may be desirable to place the container upright, or it may be desirable to place the container on its side.

It is desirable to provide a plastic container that is readily suitable for such different orientations. The label panel should be suitable for such different orientations. Similarly, an integral handle should preferably be provided that is readily usable when the container is placed in such different orientations.

In addition, the plastic container as aforesaid should have a good wall structure suitable for hot filling without wall bulging and with good wall rigidity.

Accordingly, it is a principal objective of the present invention to provide an improved plastic container suitable for placement in different orientations.

It is a further objective of the present invention to provide a plastic container as aforesaid with two label panels, one of which may be readily seen when the container is placed in different orientations.

It is a further objective of the present invention to provide a plastic container as aforesaid with a good wall structure suitable for hot filling without bulging.

Further objects and advantages of the present invention will appear hereinbelow.

SUMMARY OF THE INVENTION

In accordance with the present invention the foregoing objects and advantages are readily obtained.

The plastic container of the present invention comprises: a hollow body of plastic material having a lower supporting base; a sidewall extending upwardly from the lower base, and an upper portion extending upwardly from the sidewall, said upper portion including at least one opening therein; two label panels spaced from each other, one on the upper portion and one on the sidewall; and an integral handle at least in part on the sidewall.

The plastic container desirably is a blow molded container which has an essentially rectangular configuration, with two opposed relatively larger sidewall sections and two opposed relatively smaller sidewall sections. At least one of the sidewall sections is relatively flat so that the container can if desired be supported on the flat sidewall section.

The sidewall includes at least one and preferably at least three inwardly depressed channels extending along the sidewall of the container. Preferably, the depressed channel or channels have at least in part a wavy or swirl-like configuration.

Further features and advantages of the present invention will appear hereinbelow.

BRIEF DESCRIPTION OF THE DRAWINGS

The present invention will be more readily understandable from the accompanying drawings, wherein.

DETAILED DESCRIPTION OF PREFERRED EMBODIMENTS

Figure 1:
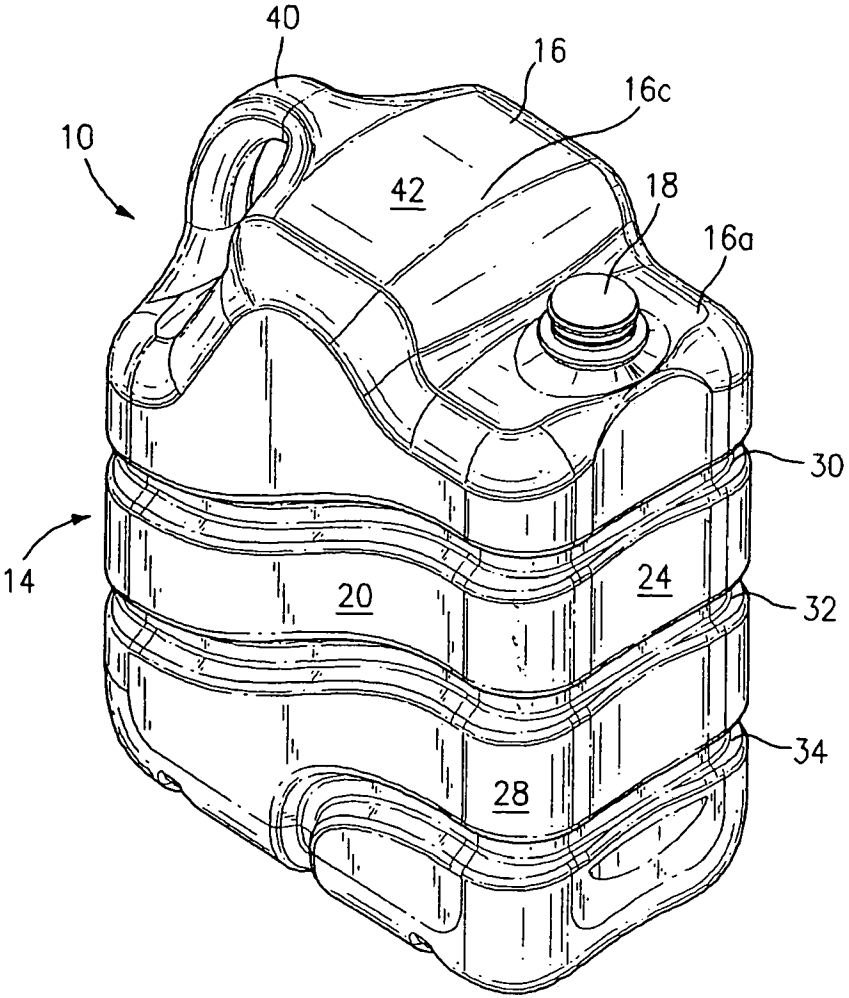
FIG. 1 is a perspective view of one embodiment of a container of the present invention showing the upper portion, left sidewall and front sidewall.

Referring to the drawings, FIGS. 1–7 show one embodiment of the plastic container of the present invention.

FIGS. 1–7 show container 10 with a lower supporting base 12 (FIG. 7), sidewall 14 extending upwardly from the lower base 12, and upper portion 16 extending upwardly from the sidewall. In the embodiment of FIGS. 1–7, upper portion 16 includes a single opening 18 located on the front side 16*a* of upper portion 16.

Container 10 includes opposed, relatively larger sidewall sections, namely left sidewall section 20 and right sidewall section 22, and opposed, relatively smaller sidewall sections, namely front sidewall section 24 and rear sidewall section 26. The larger sidewall sections 20, 22 alternate with the smaller sidewall sections 24,26. The container 10 has an essentially rectangular configuration with the four sidewall sections joined by rounded sidewall corners 28. Therefore, the larger sidewall sections are each joined to two smaller sidewall sections in an alternating large-small relationship.

The sidewall 14 includes at least one and preferably more than one inwardly depressed channels. In the embodiment of FIGS. 1–7, three of these channels are shown, upper channel 30, intermediate channel 32 and lower channel 34. The channels provide rigidity to the container and keep the container from bulging outwardly as during hot or cold filling, transportation and use. The exact number of channels will depend on the size and shape and contents of the container. In the embodiment of FIGS. 1–7, the rectangular container is a 2.5 gallon container. The depth and width of the channels will also depend on the size and use of the container. It is preferred that the container of the present invention have a capacity of at least one gallon and desirably at least two gallons.

As shown in FIGS. 1–7, the sidewall channels have at least in part a wavy or swirl-like configuration so that they travel (generally) laterally across the sidewall and partly longitudinally. This wavy configuration has been found to provide a uniform rigidity with a minimum number of channels.

Figure 7:
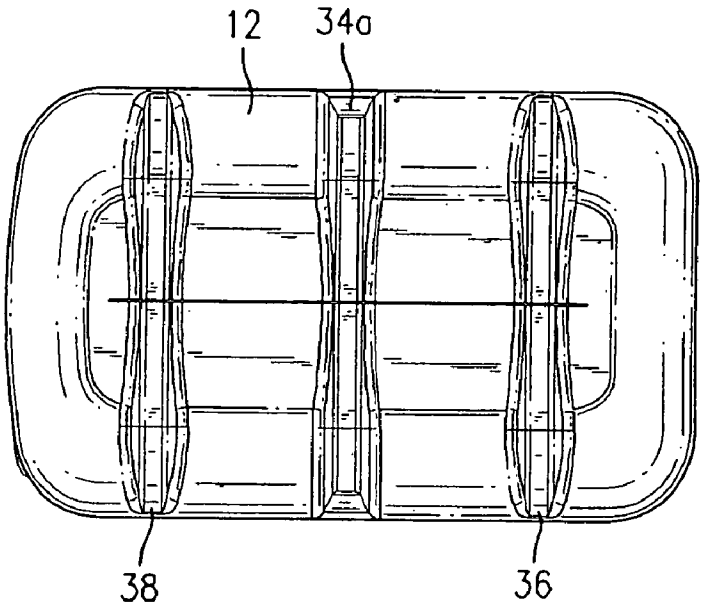
FIG. 7 is a bottom view of the container of FIG. 1 showing the lower supporting base.
Figure 6:
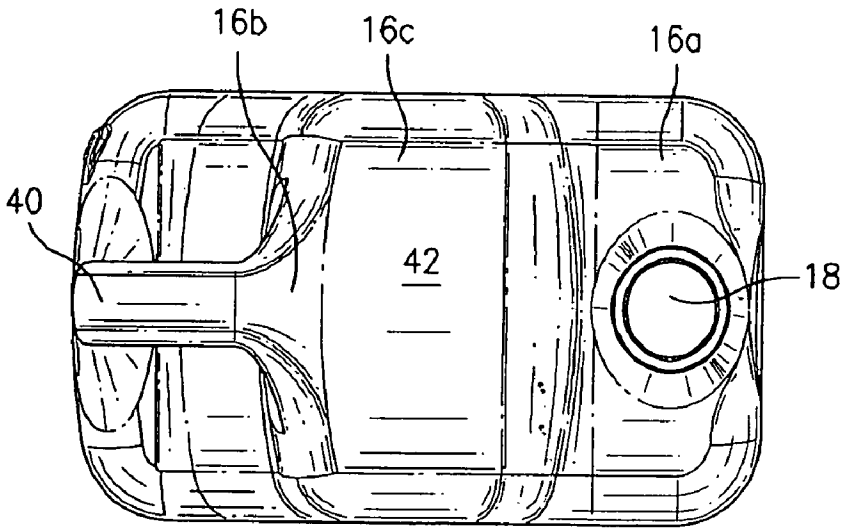
FIG. 6 is a top view of the container of FIG. 1 showing the upper portion.

As can be seen, all of the depressed channels are continuous, i.e., uninterrupted. Upper channel 30 traverses right sidewall 22, front sidewall 24 and left sidewall 20. Intermediate channel 32 traverses all four sidewalls, continuously circumscribing sidewall 14. Lower channel 34 traverses front sidewall 24 and partly traverses right 22 and left 20 sidewalls, turning downwardly to extend over lower supporting base 12 via intermediate base channel 34*a* as shown in FIG. 7. Base 12 also includes two additional depressed channels, front base channel 36 and rear base channel 38, one on either side of intermediate base channel 34*a*. The base channels serve to effectively provide rigidity to the base.

Container 10 also includes an integral handle 40. In the embodiment of FIGS. 1–7, handle 40 has a curved configuration and extends from the upper side 26*a* of rear sidewall section 26 to the rear side 16*b* of upper portion 16, with recessed area 41 beneath the handle to allow easy grasping of the handle.

Advantageously, container 10 includes two label panels, namely upper label panel 42 and sidewall label panel 44. The upper label panel 42 is located on the central side 16*c* of upper portion 16, and the sidewall label panel 44 is located on the central side 26*c* of rear sidewall section 26.

Figure 2:
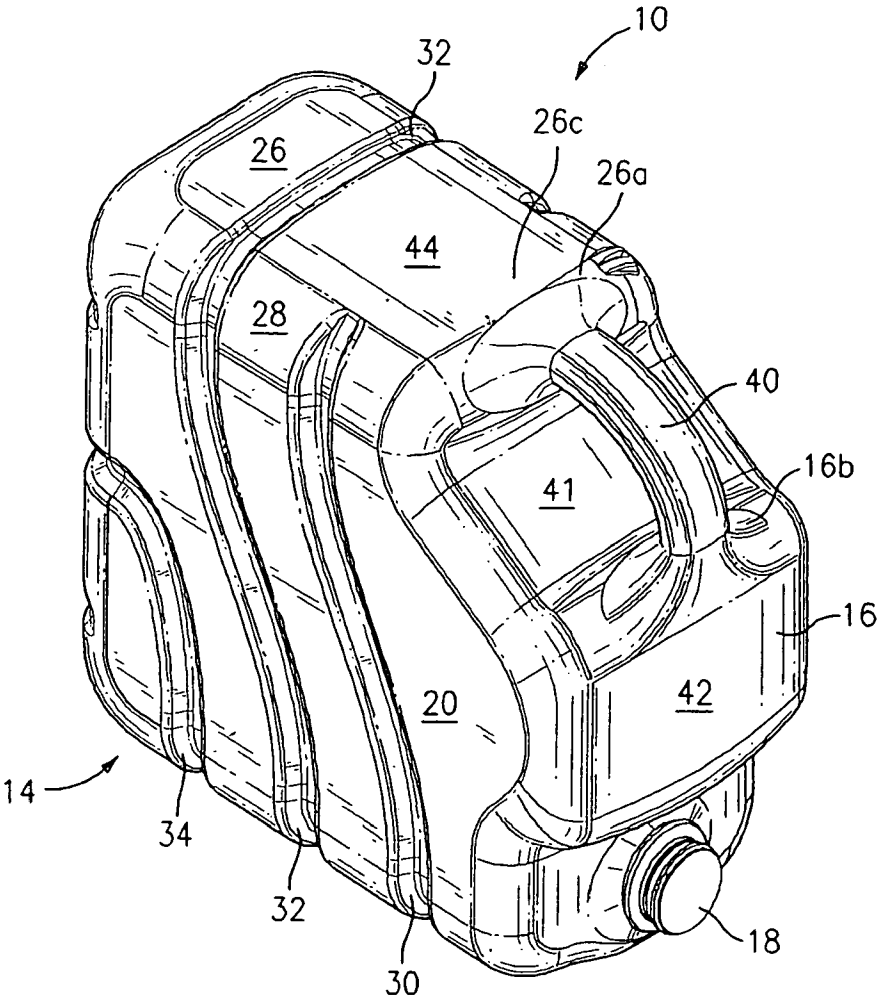
FIG. 2 is a perspective view of the container of FIG. 1 showing the upper portion, rear sidewall and left sidewall.
Figure 5:
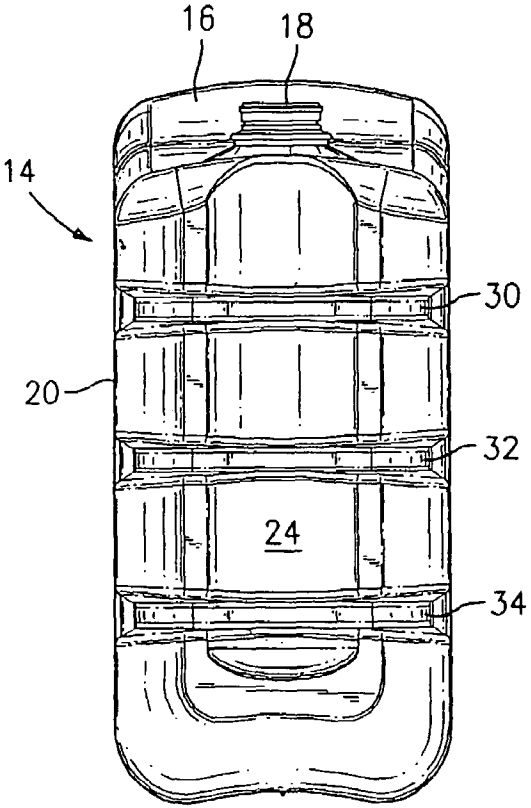
FIG. 5 is a side view of the container of FIG. 1 showing the front sidewall.
Figure 3:
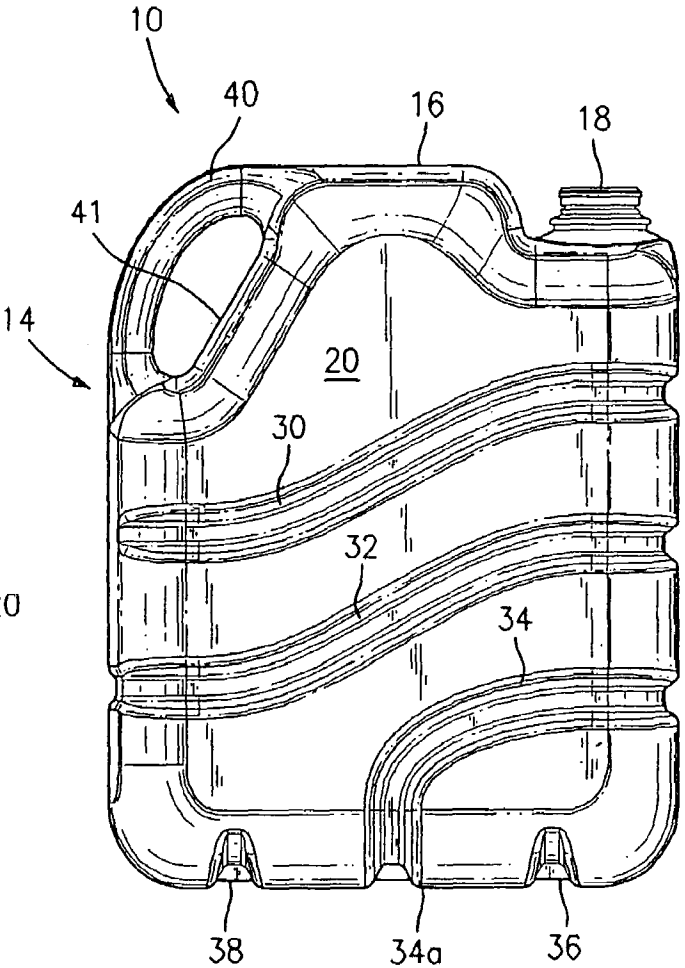
FIG. 3 is a side view of the container of FIG. 1 showing the left sidewall.
Figure 4:
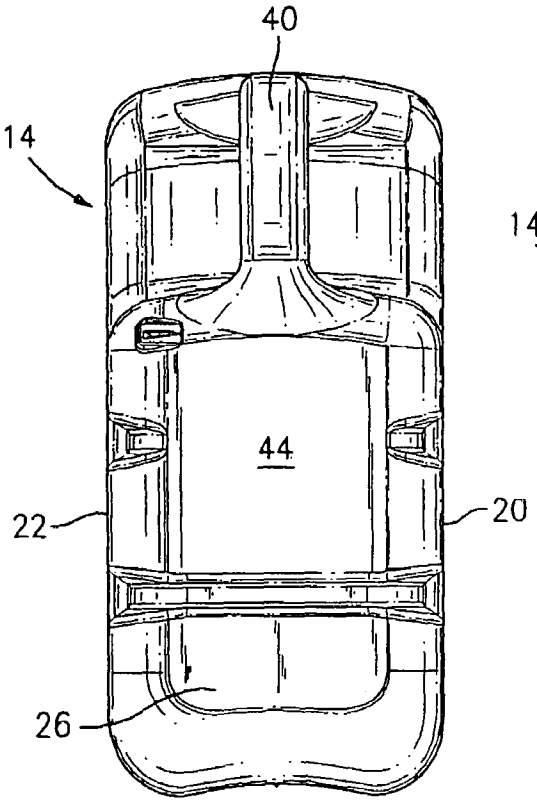
FIG. 4 is a side view of the container of FIG. 1 showing the rear sidewall.

Thus, a label can be applied to upper label panel 42 and also to sidewall label panel 44. This permits a label to be exposed when the container is in an upright orientation as shown in FIG. 4, or positioned on its side as shown in FIG. 2. In both of these configurations handle 40 is forwardly oriented as shown in both positions for convenient grasping to easily remove the container from storage or from refrigeration.

Alternatively, one can attach or employ a dispensing head to the opening in the orientation of FIG. 2 and dispense directly from the container in the refrigerator.

The container 100 in FIGS. 8–14 is a further embodiment showing a 2.5 gallon container with a lower supporting base 112, sidewall 114 extending upwardly from the lower base, and upper portion 116 extending upwardly from the sidewall. In the embodiment of FIGS. 8–14, upper portion 116 includes a first opening 118*a* located on front side 116*a* of upper portion 116, and a second opening 118*b* located on the rear side 116*b* of upper portion 116. First opening 118*a* is the larger opening and is for pouring or dispensing, and second opening 118*b* is the smaller opening and is for venting.

Similar to the embodiment of FIGS. 1–7, container 100 includes opposed, relatively larger sidewall sections, namely left sidewall section 120 and right sidewall section 122, and opposed, relatively smaller sidewall sections, namely front sidewall section 124 and rear sidewall section 126. The container 100 has an essentially rectangular configuration similar to FIGS. 1–7, with the four sidewall sections joined by rounded sidewall corners 128. The larger sidewall sections are each joined to two smaller sidewall sections in an alternating large-small relationship.

The sidewall 14 includes at least one and preferably more than one inwardly depressed channel similar to the embodiment of FIGS. 1–7. In the embodiment of FIGS. 8–14, three of these channels are shown, upper channel 130, intermediate channel 132 and lower channel 134.

The sidewall channels in the embodiment of FIGS. 8–14 have a wavy configuration similar to the embodiment of FIGS. 1–7; however, the orientation is somewhat different. The upper channel 130 traverses left sidewall 120, front sidewall 124 and right sidewall 122 in a continuous, uninterrupted manner. However both intermediate channel 132 and lower channel 134 traverse front sidewall 124 and partly traverse right and left sidewalls 122 and 120, turning downwardly to extend over lower supporting base 112 in rear base channel 132*a* and intermediate base channel 134*a*. Base 12 also includes front base channel 136.

Container 100 includes integral handle 140. In the embodiment of FIGS. 8–14, handle 140 has a straight configuration and extends over the central side 126*c* of rear sidewall section 126 with recessed area 141 beneath the handle for easy gripping.

Similar to the embodiment of FIGS. 1–7, container 100 advantageously includes two label panels, namely upper label panel 142 and sidewall label panel 144. The upper label panel 142 is located on the central side 116*c* of upper portion 116, and the sidewall label panel 144 is located on the lower side 126*b* of rear sidewall section 126.

Figure 9:
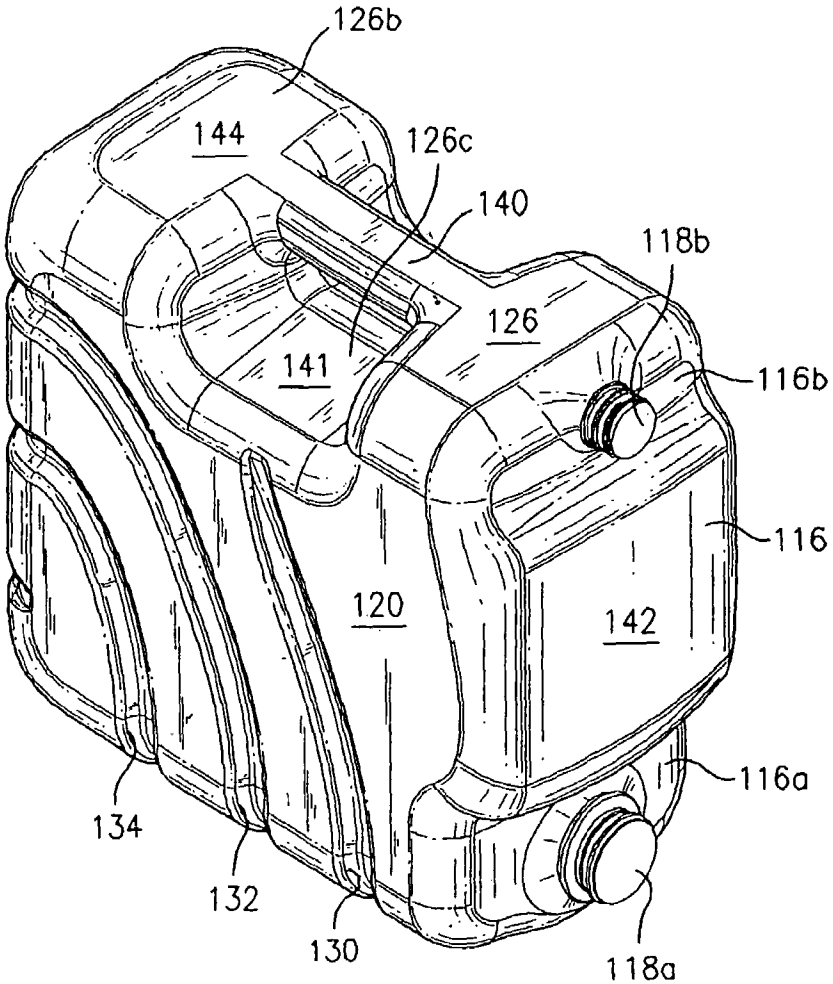
FIG. 9 is a perspective view of the container of FIG. 8 showing the upper portion; rear sidewall and left sidewall.
Figure 8:
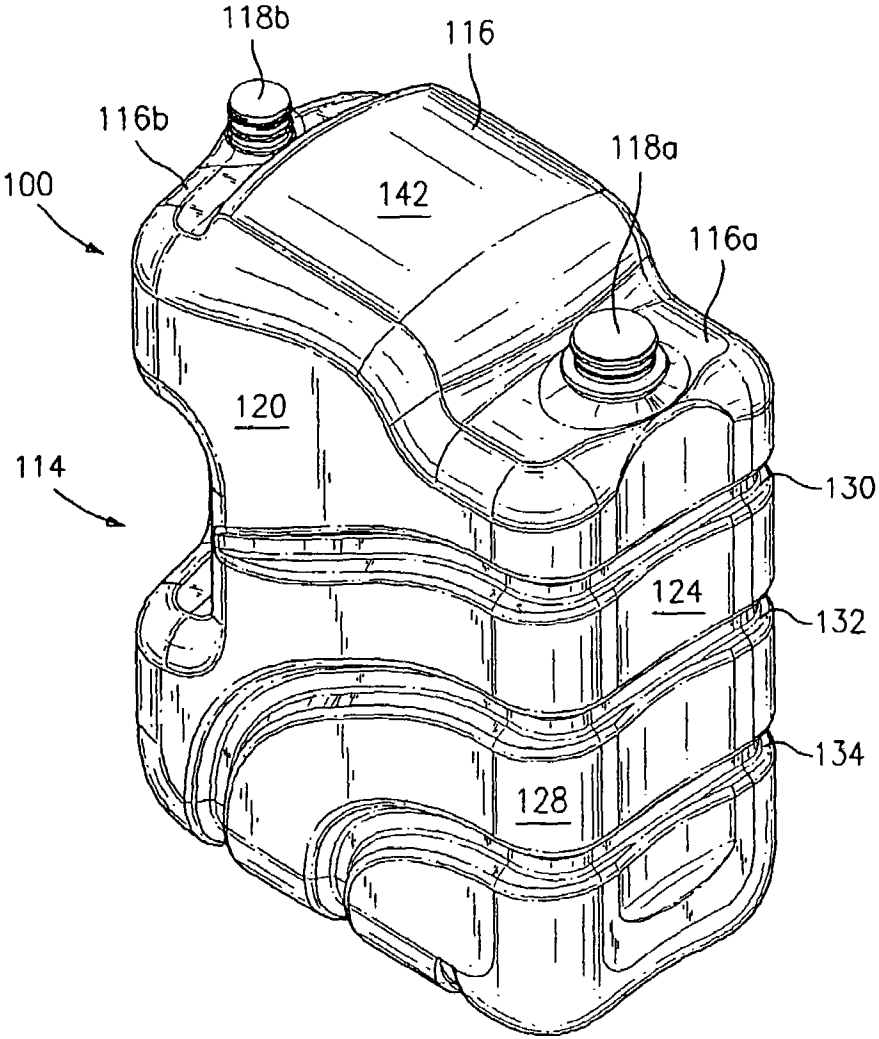
FIG. 8 is a perspective view of a further embodiment of the container of the present invention showing the upper portion, left sidewall and front sidewall.
Figure 12:
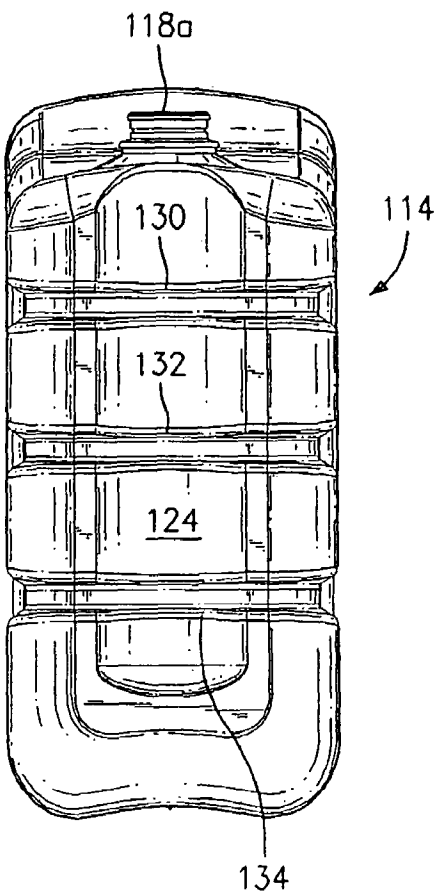
FIG. 12 is a side view of the container of FIG. 8 showing the front sidewall.
Figure 10:
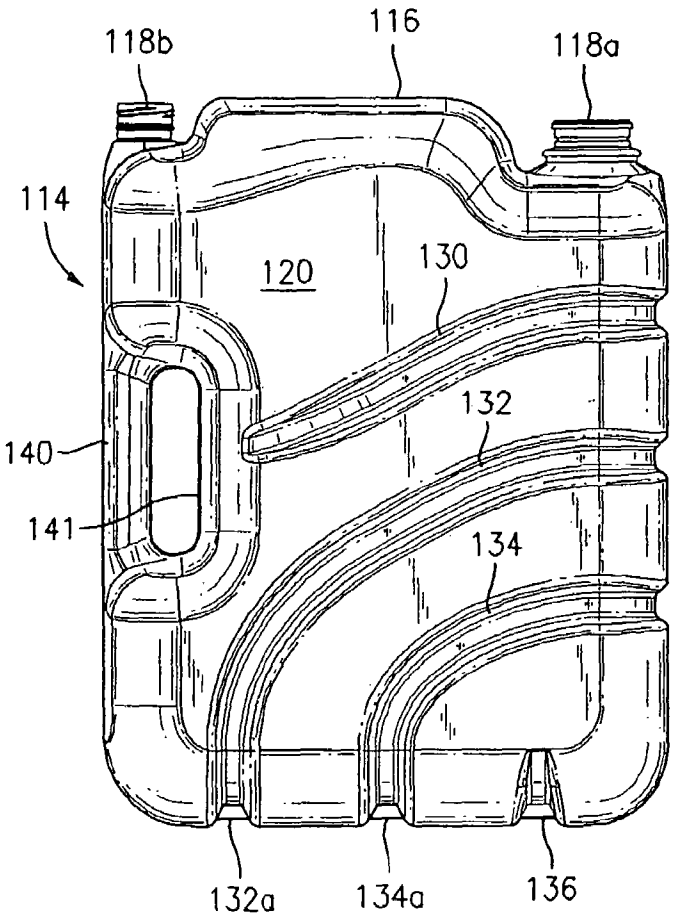
FIG. 10 is a side view of the container of FIG. 8 showing the left sidewall.
Figure 11:
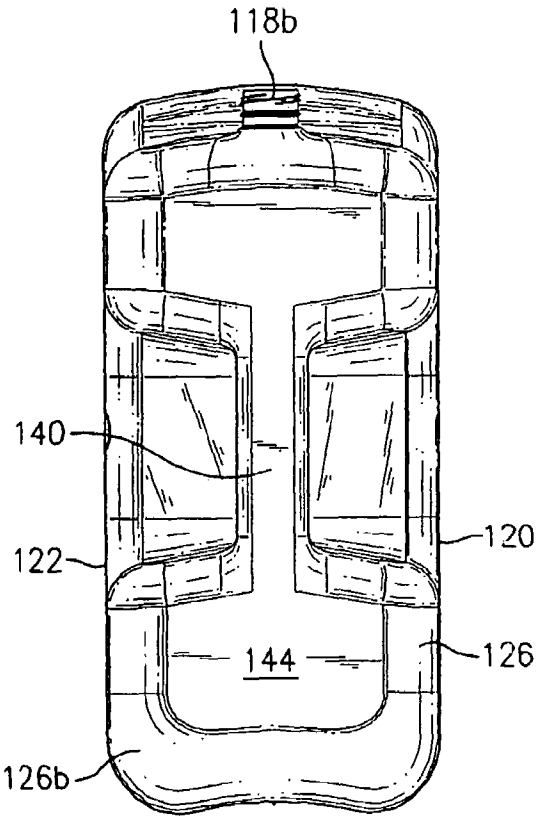
FIG. 11 is a side view of the container of FIG. 8 showing the rear sidewall.
Figure 14:
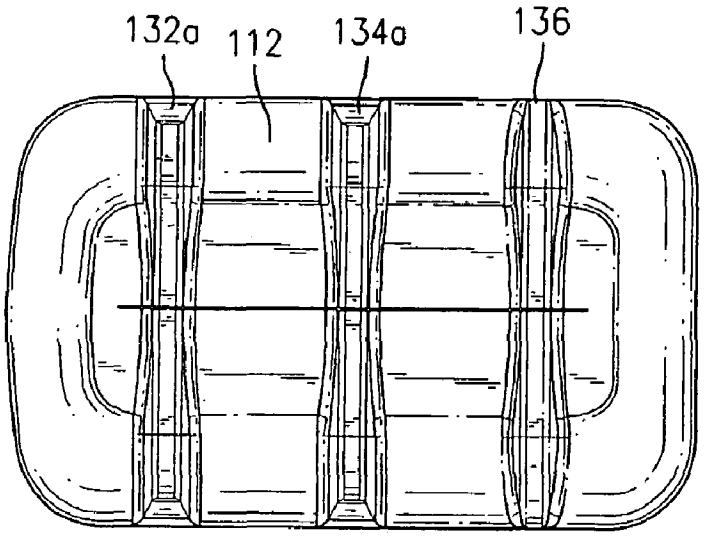
FIG. 14 is a bottom view of the container of FIG. 8 showing the lower supporting base.
Figure 13:
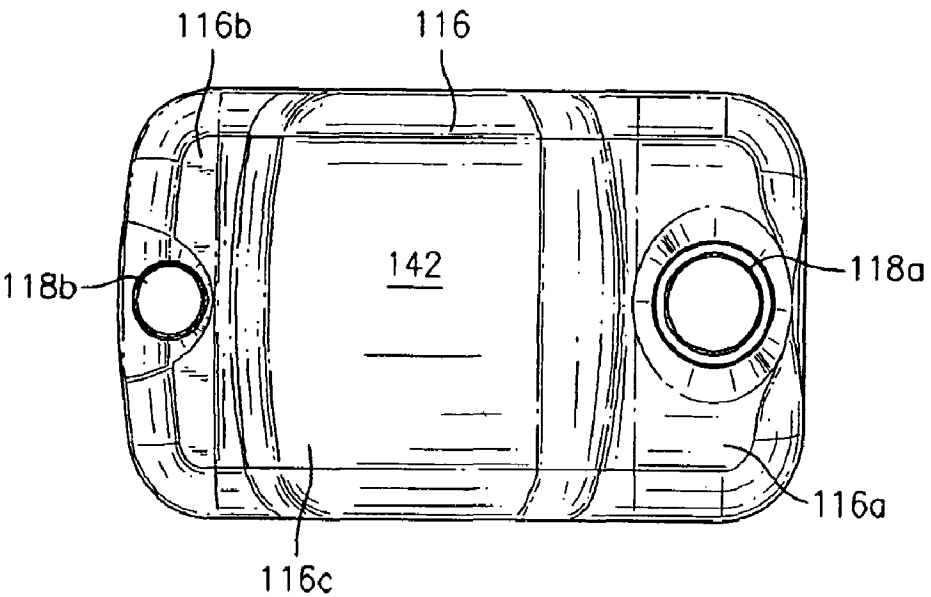
FIG. 13 is a top view of the container of FIG. 8 showing the upper portion.

Thus, a label can be applied to upper label panel 142 and also to sidewall label panel 144. This permits a label to be exposed when the container is in an upright orientation as shown in FIG. 11, or positioned on its side as shown in FIG. 9. In both of these configurations handle 140 is conveniently oriented as shown in both positions for convenient grasping to easily remove the container from storage or from refrigeration.

Figure 15:
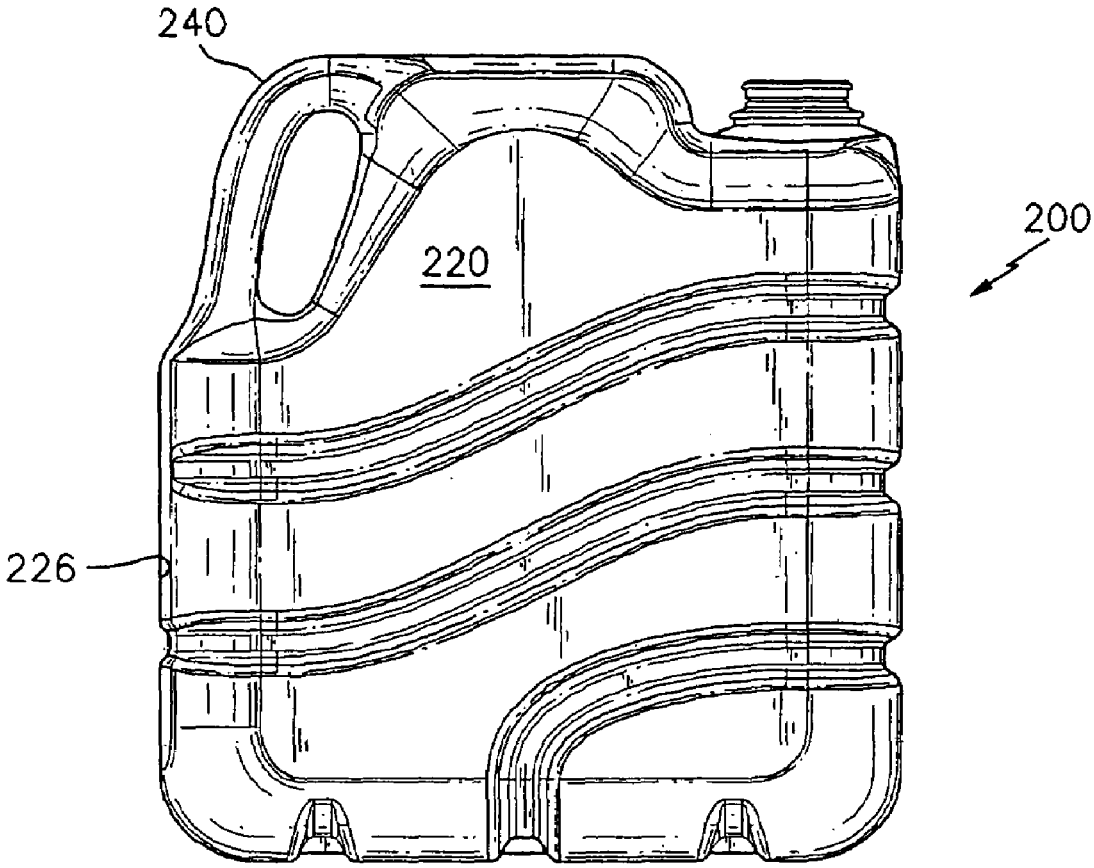
FIG. 15 is a side view of a still further embodiment of the container of the present invention showing the left sidewall.

The embodiment of FIG. 15 shows container 200, which is similar to container 10 of FIGS. 1–7 except that handle 240 has a slightly different configuration to permit easier removal of container 200 from the blow mold in which it is prepared. The handle 240 is positioned inwardly of the rear sidewall 226 and is less curved with a slight curve or a generally straight configuration.

Thus, the container of the present invention offers considerable advantages. The two label panels are quite convenient in permitting storage of the container with easy label viewing in different orientations. Handle positioning permits easy access to the container and wall construction allows rigidity and freedom from undesirable bulging.

The container may be prepared from any desired plastic material, such as polyethylene, polyethylene terephthalate, polypropylene, or any other desired plastic. Preferably a high strength plastic material is used for the larger size containers, such as high density polyethylene.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A plastic container, which comprises:

a hollow body of plastic material having a lower supporting base, a sidewall extending upwardly from the lower base, and an upper portion extending upwardly from the sidewall and consisting of a top wall, said top wall including two openings spaced from each other, wherein the sidewall includes at least three inwardly depressed channels extending at least in part along the sidewall of the container which are spaced from each other, each at least in part having a wavy configuration;

two label panels spaced from each other, one on the top wall between the two openings and one on the sidewall; and an integral handle at least in part on the sidewall.

2. A container according to claim 1, wherein said container has an essentially rectangular configuration, and the sidewall consists of two opposed relatively larger sidewall sections and two opposed relatively smaller sidewall sections.

3. A container according to claim 2, wherein at least one of said sidewall sections is relatively flat so that the container may be supported on said flat sidewall section.

4. A container according to claim 2, wherein said sidewall sections are connected by rounded corners.

5. A container according to claim 2, wherein at least two of said channels extend continuously along at least three of said sidewall sections.

6. A container according to claim 2, wherein one of said label panels is located on one of said relatively smaller sidewall sections.

7. A container according to claim 2, wherein the handle is located on one of said relatively smaller sidewall sections.

8. A container according to claim 7, wherein the handle is located on one of said relatively smaller sidewall sections adjacent a label panel.

9. A container according to claim 2, wherein at least one of said channels extends continuously over said two relatively larger sidewall sections and one relatively smaller sidewall section.

10. A container according to claim 2, wherein said container is a blow molded plastic container with a capacity of at least one gallon.

11. A container according to claim 2, wherein said container is a blow molded plastic container with a capacity of at least two gallons.

12. A container according to claim 1, wherein said top wall extends essentially perpendicular to said sidewall.

13. A container according to claim 1, wherein at least one of said channels extends from the sidewall onto the lower base.

14. A container according to claim 1, wherein at least one of said channels completely and continuously circumscribes the sidewall.

* * * * *